US006123888A

United States Patent [19]

Smith

[11] Patent Number: 6,123,888

[45] Date of Patent: Sep. 26, 2000

[54] METHOD OF MANUFACTURING POST TENSIONING PREFABRICATED BUILDING

[75] Inventor: Rodney I. Smith, Fauquier County, Va.

[73] Assignee: Easi-Set Industries, Midland, Va.

[21] Appl. No.: 09/126,727

[22] Filed: Jul. 31, 1998

Related U.S. Application Data

[62] Division of application No. 08/988,560, Dec. 11, 1997, Pat. No. 5,875,595.

[51] Int. Cl.[7] ..... B28B 1/14

[52] U.S. Cl. ..... 264/228; 264/229

[58] Field of Search ..... 264/228, 229

[56] References Cited

U.S. PATENT DOCUMENTS 3,036,356 5/1962 Greulich .
3,195,277 7/1965 Greulich .
3,513,609 5/1970 Lang .
4,432,175 2/1984 Smith .
5,342,568 8/1994 Yokota .

*Primary Examiner*—Karen Aftergut
*Attorney, Agent, or Firm*—McGuire, Woods, Battle& Boothe, LLP

[57] ABSTRACT

An improved post tensioning system for prefabricated building panels in which a concentric uniform radial compression is maintained in the slab. A post tensioning cable is placed in the concrete slab to form a perimeter loop starting from one corner of the slab to a point where the cable entered the slab and at a point turning 90° to follow that portion of the cable in the periphery to a point midway up the Y axis and then turning 90° across the X axis to bisect the slab and cross the opposite parallel portion of the cable to exit out the adjacent side of the slab. This creates a cable pattern with no less than 2.5 parallel cables in any direction.

7 Claims, 8 Drawing Sheets

METHOD OF MANUFACTURING POST TENSIONING PREFABRICATED BUILDING

This is a divisional application of now U.S. patent application Ser. No. 08/988,560 filed on Dec. 11, 1997 now U.S. Pat. No. 5,875,595.

Background of The Invention

1. Field of the Invention

The present invention generally relates to prefabricated concrete building panels and, more particularly, to improvements in post tensioned concrete slabs in which there is a better distribution and an increase in compression forces in small slabs.

2. Background Description

In U.S. Pat. No. 4,432,175 issued to Rodney I. Smith discloses a post tensioned concrete slab in which one or more continuous reinforcement cables are positioned in a mold, around and near its outer periphery. These cables are lubricated and sheathed to prevent adherence to the concrete. The concrete is poured and cured, and each cable is post tensioned and anchored. The tensile force of each cable is therefore exerted toward the center of the slab as well as from side to opposite side. This results in a slab that can be relatively small and lightweight but has high strength, resistance to cracking and deterioration, and is relatively impermeable to liquids and gases.

While the prior design was, and continues to be, an excellent building product, the distribution of compressive forces tends to be strongly biased along one of the major axes of the panel. This is due to the rigid mold and straight line cable requirement of pretensioning and the single post tensioned perimeter loop design which exits strands at a single corner which attempts to provide uniform compression force in both principle axes of a small rectangular slab. This, in turn, meant that the product just met the criteria for post tensioning under the American Concrete Institute (ACI) guidelines. As a result, an improved design for the post tensioned building panel is highly desirable.

SUMMARY OF THE INVENTION

It is therefore an object of the invention to provide an improved post tensioning system for prefabricated concrete building panels of relatively small size where linear post tensioning would not work due to short cable lengths.

It is another object of the invention to provide a prefabricated concrete building panel in which the variation in compressive forces is reduced while the average compressive force is increased.

According to the invention, there is provided a prefabricated concrete construction panel which overcomes the limits of post tensioning as disclosed in U.S. Pat. No. 4,432,175. Specifically, by maintaining a concentric uniform radial compression in the slab, the benefits of limited crack size and amalgamated healing of the limited crack are realized due to the tendency of the concrete to reunite and form a new crystalline seal from the radial compression forces and continued presence of sufficient humidity in the concrete. In the practice of the invention, a post tensioning cable is placed in the concrete slab to form a perimeter loop starting from one corner of the slab to a point where the cable entered the slab and at a point turning 90° to follow that portion of the cable in the periphery to a point midway up the Y axis and then turning 90° across the X axis to bisect the slab and cross the opposite parallel portion of the cable to exit out the adjacent side of the slab. This creates a cable pattern with no less than 2.5 parallel cables in any direction and reduces concentrated forces in one corner of the slab.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
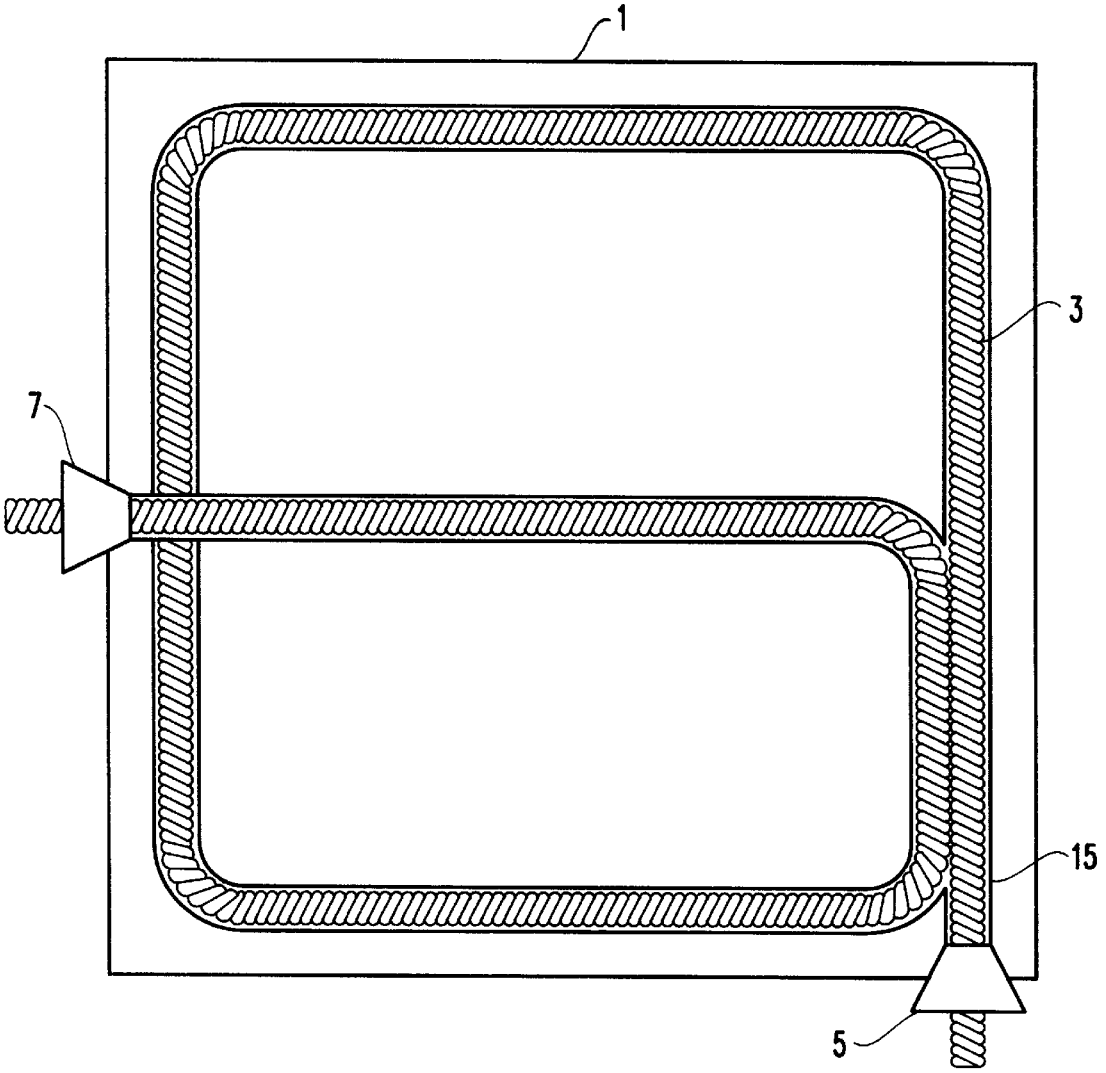
FIG. 1 is a plan view of a concrete building panel according to the invention.

Referring now to the drawings, and more particularly to FIG. 1, there is shown a post tensioned concrete building panel indicated generally at 1 provided with a post tensioned cable 3 toward its outer periphery. The opposite ends of the cable 3 are secured by wedges 5 and 7.

The cable 3 forms a perimeter loop starting from one corner of the slab to a point where the cable entered the slab and at a point turning 90° to follow the existing cable to a point midway up the Y axis and then turning 90° across the X axis to bisect the slab and cross the opposite parallel cable to exit out the adjacent side of the slab. This creates a cable pattern with no less than 2.5 parallel cables in any direction. The cable 3 is preferably a hard drawn steel cable, but any flexible high-tensile strength material can be similarly employed.

The cable 3 is within a plastic sheath 15 which forms a channel extending around the periphery of the slab 1 and across the central portion of the slab 1. Cable 3 will be lubricated to facilitate its movement within sheath 15.

Figure 2:
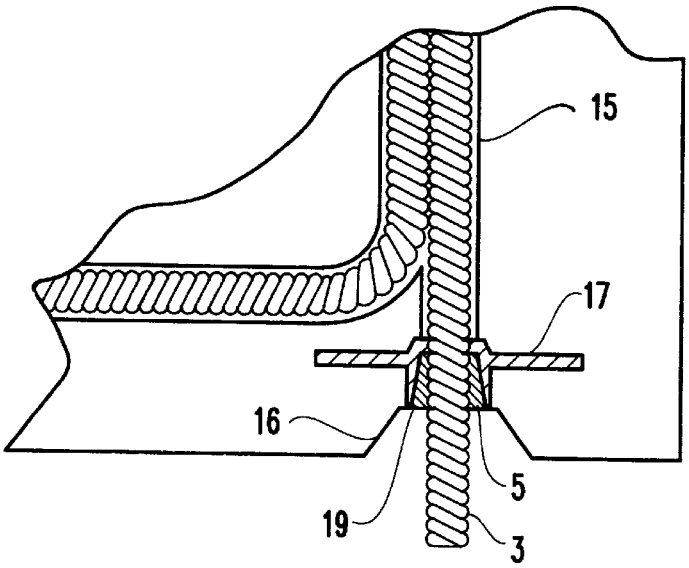
FIGS. 2 and 3 are enlarged views of portions of FIG. 1 showing the tensioning of the cable.
Figure 3:
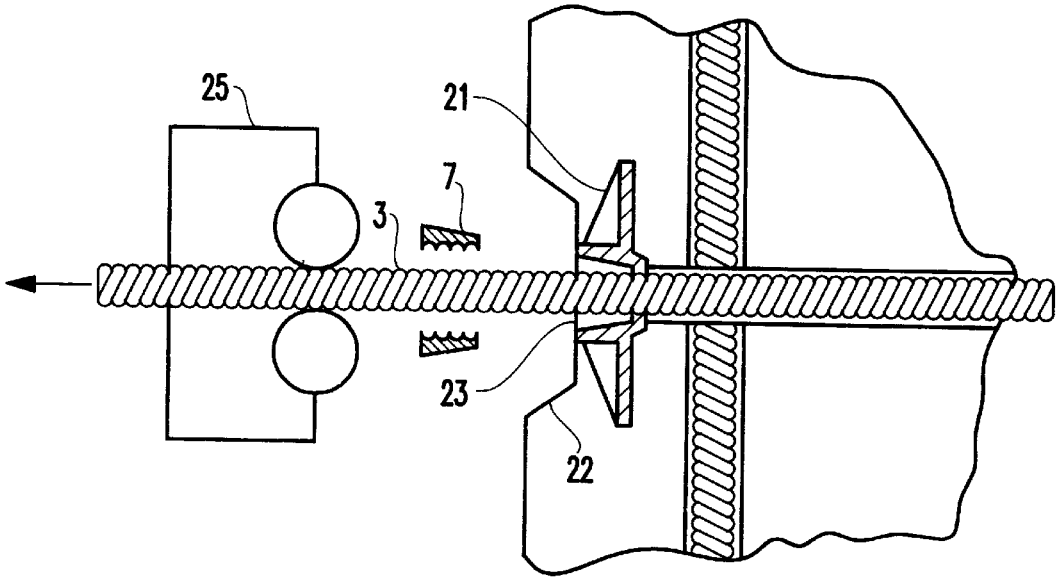

The post tensioning process is illustrated in FIGS. 2 and 3. When the concrete, which forms building panel 1 is poured, the sheath 15 and cable 3 are positioned so that the opposite ends of cable 3 extend outwardly from one corner (FIG. 2) and a side opposite that corner (FIG. 3). The one corner is provided with an anchor 17, such as the anchor component of the VSL S5N anchorage system. The anchor 17 has an aperture 19 in registry with a pocket 16 formed in the edge of the slab for access to the end of cable 3 and anchorage system 17 and 5. Likewise, as shown in FIG. 3, a second anchor 21 having an aperture 23 in registry with a pocket 22 formed in the edge of the slab for access to the opposite end of cable 3 and anchorage system 21 and 7 is provided in the side of the panel.

After the concrete has become relatively hardened (approximately twenty-four hours after it has been poured), there is an initial tensioning of the cable 3. This initial tensioning adds stripping strength to the slab that allows the mold to be removed more easily and with minimal surface deterioration. To accomplish this initial tensioning, the mold is removed and wedges 5 (FIG. 2) are applied to one end of the cable 3. The wedges are composed of two frustro-conically shaped halves which are partially inserted into an aperture and frictionally clamp the cable by means of teeth formed in the interior surfaces of the wedges.

With the wedges 5 gripping the one end of the cable 3, the other end of the cable is connected to a tensioning device 25, such as a hydraulic jack or similar device, for pulling the cable 3 in the direction indicated by the arrow in FIG. 3. A tensioning force is exerted on the cable 3 until an optimum stress in the cable is approximately equal to 0.7 $F_u$ ($F_u$=270 kips per square inch (ksi)) is attained. This tensioning of the cable draws the wedges 5 into the aperture 19, thereby anchoring that end of the cable 3. While the cable is tensioned, the wedges 7 (FIG. 3) are applied to the end of the cable which extends beyond aperture 23. Tensioning device 25 is then released, and the tensile force of the cable 3 draws the wedges 7 into aperture 23, resulting in a final stress on the cable of 0.7 $F_u$. The cable is trimmed and the pockets 16 and 22 are filled.

Figure 4:
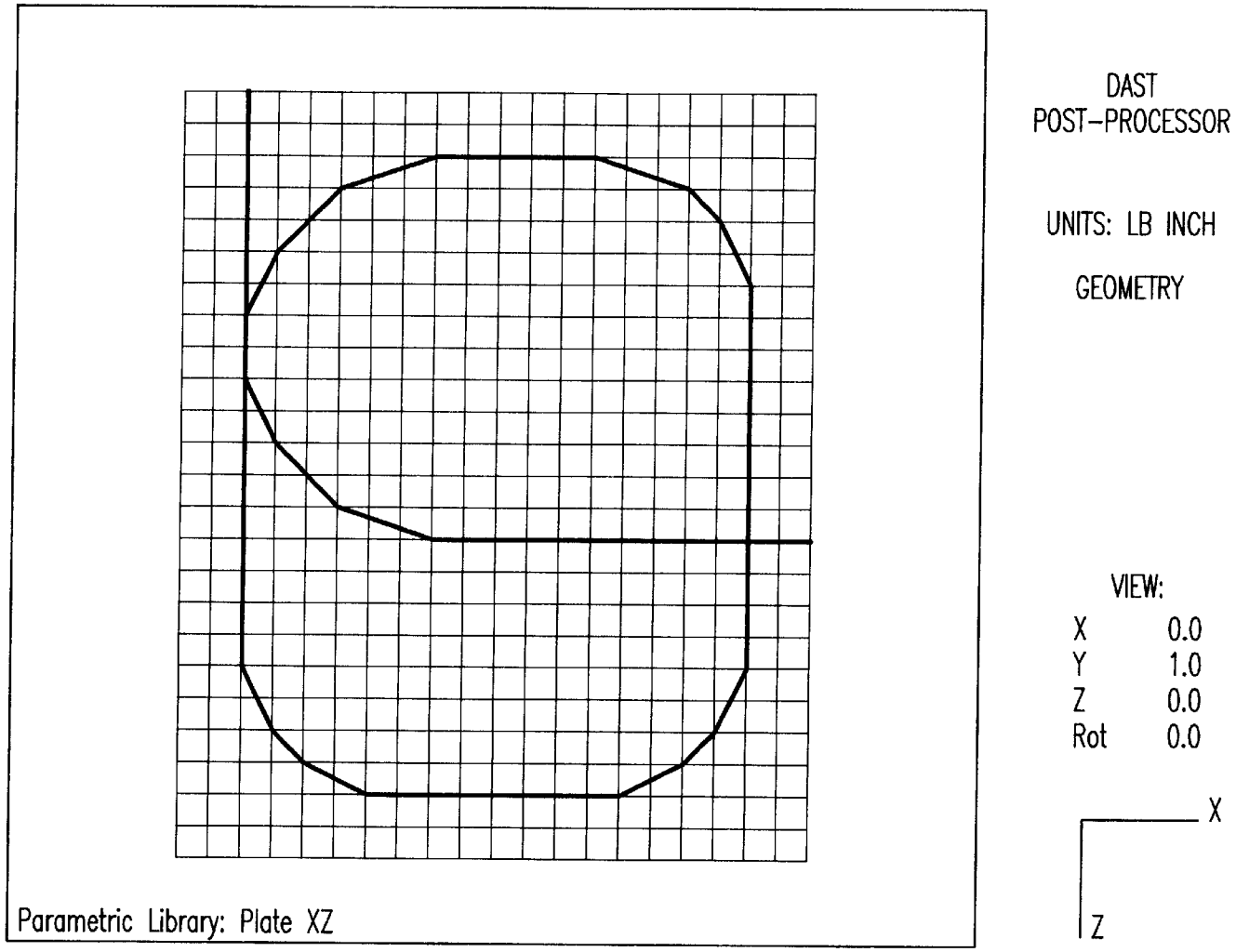
FIG. 4 is a model of a 12'×10'×4" panel composed of 480 six inch squares using the new loop configuration according to the invention.
Figure 5:
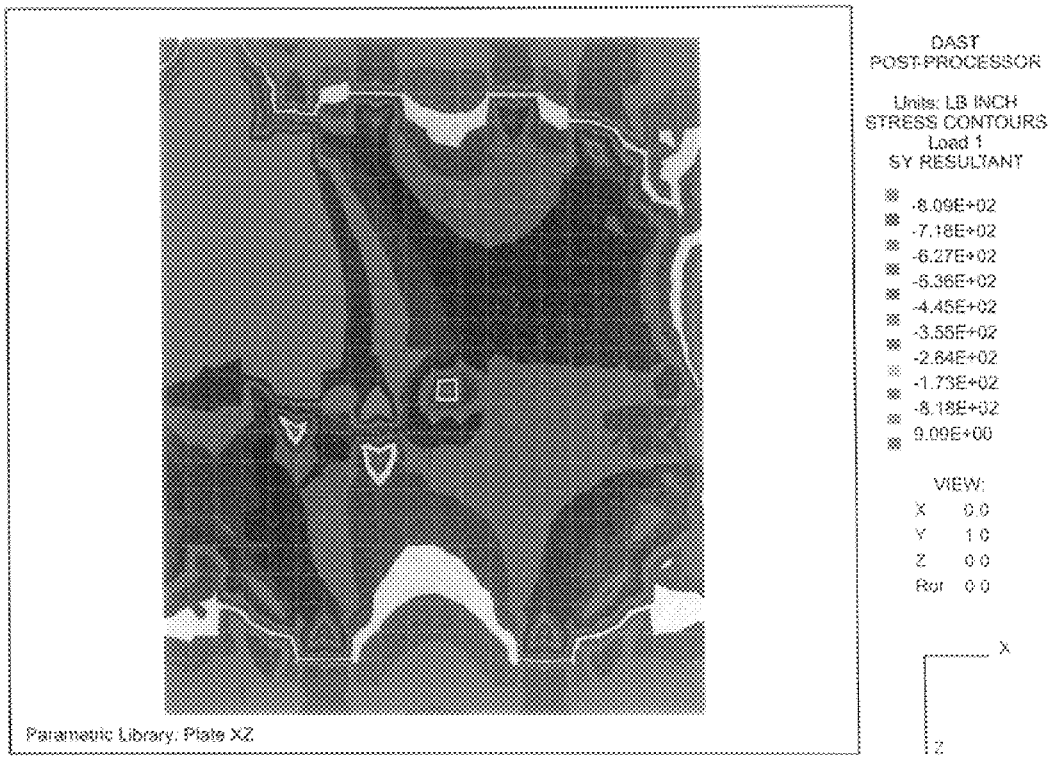
FIG. 5 is a stress contour map of a building panel made in accordance with the invention showing compression in the Y axis.
Figure 6:
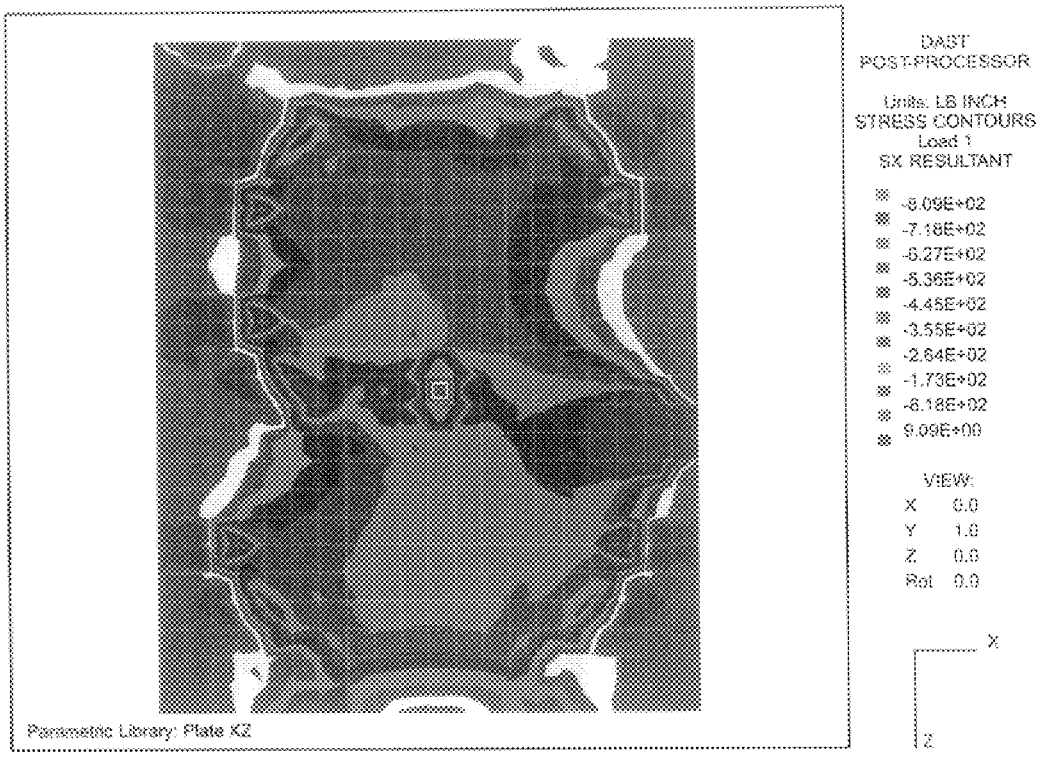
FIG. 6 is a stress contour map of the same building panel as in FIG. 4 showing compression in the X axis.
Figure 7:
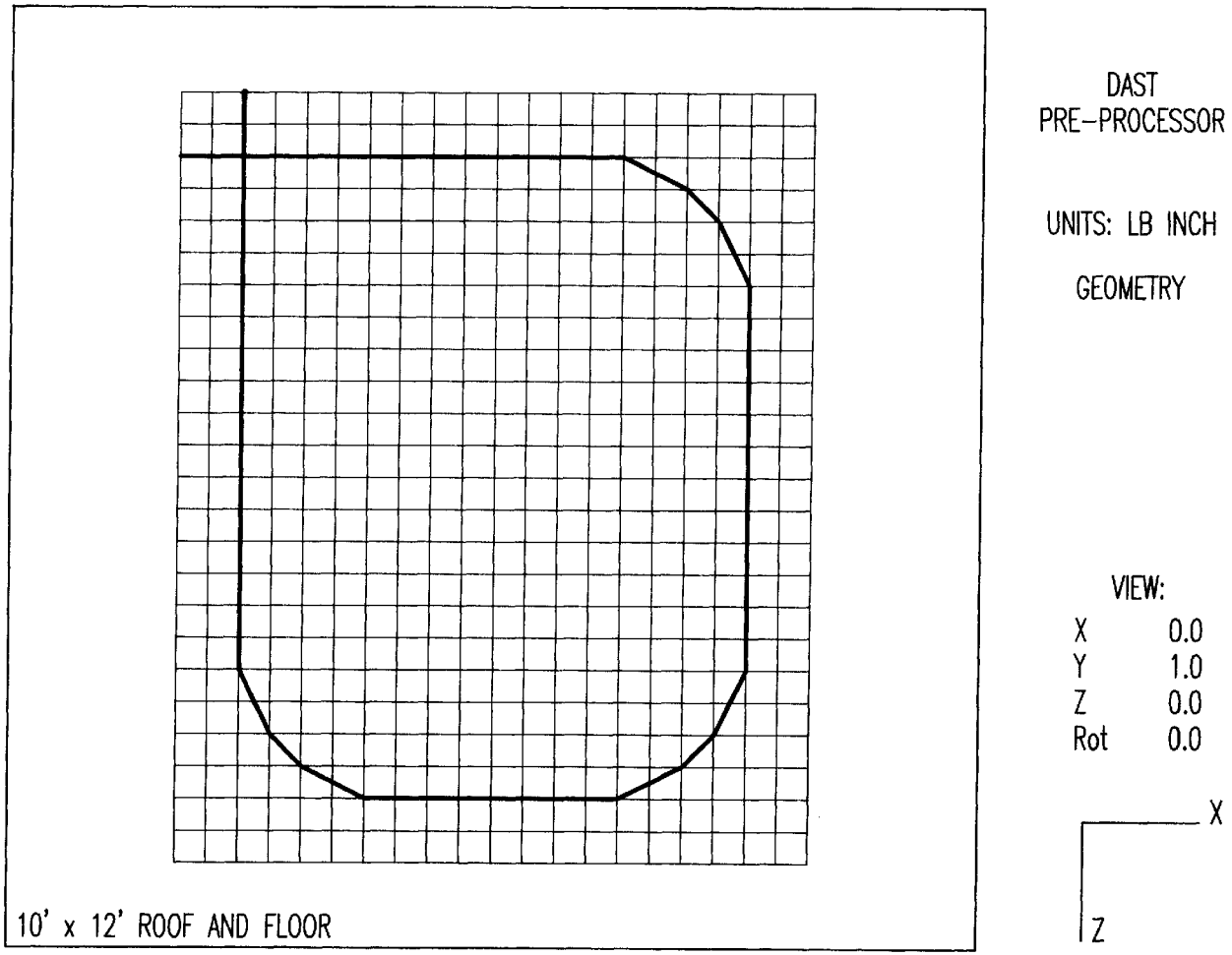
FIG.7 PRIOR ART
FIG. 7 is a model of a 12'×10'×4" panel composed of 480 six inch squares using the old loop configuration.
Figure 8:
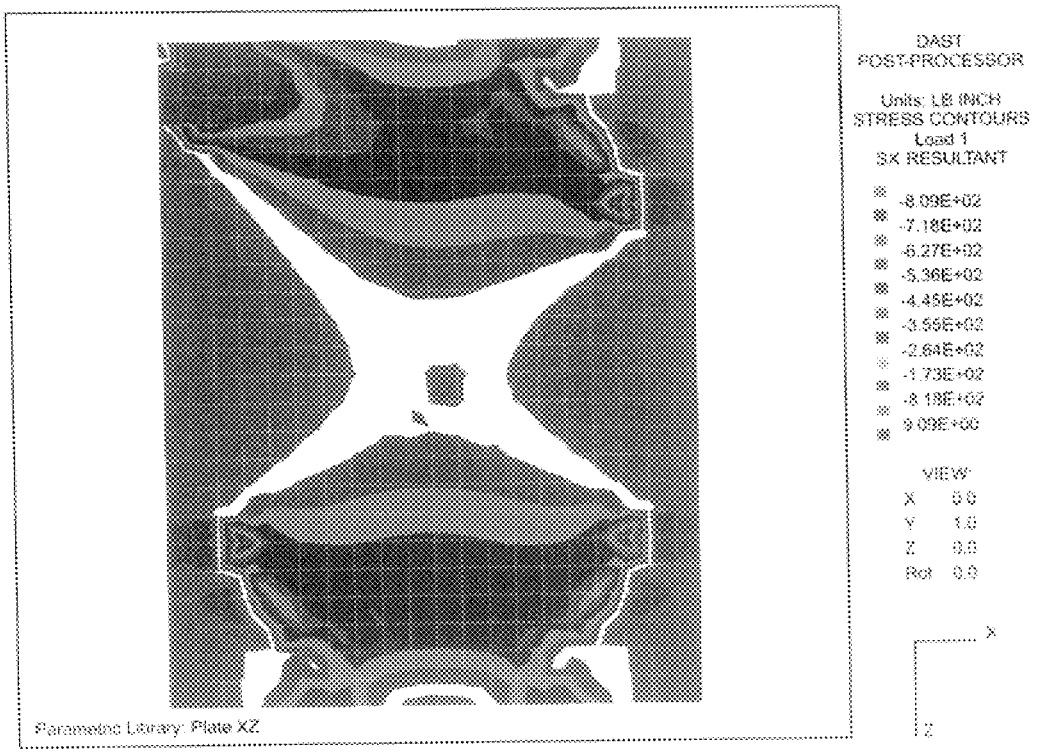
FIG. 8 is a stress contour map of a building panel modeled in FIG. 7 showing compression in the Y axis.
Figure 9:
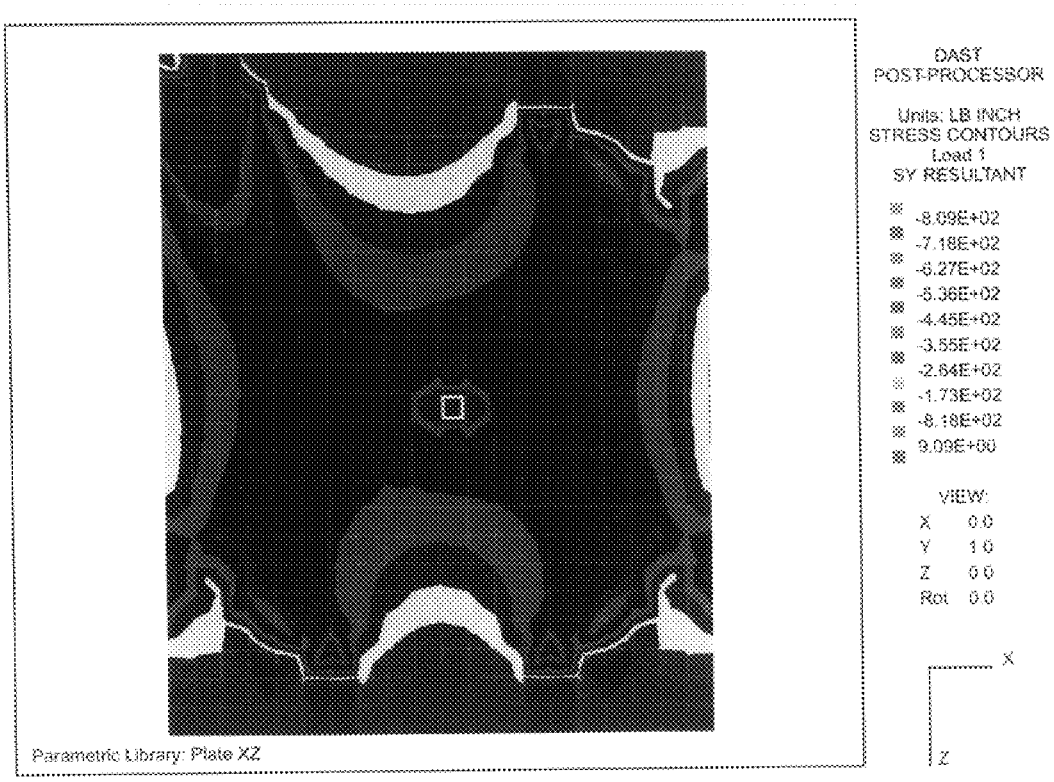
FIG. 9 is a stress contour map of the same building panel as in FIG. 7 showing compression in the X axis.

The tensioning process results in a post tensioned building panel which, due to the improved configuration of the cable 3, results in a better distribution of compression forces in small slabs less than twenty feet across. For such slabs, a finite analysis demonstrates the improved results of the present invention. The analysis of the new building panel configuration of the post-tensioned cable was performed on a finite-analysis program developed by DAST Consulting. The program input utilized the known stress/strain relationship and thermal coefficient of expansion and contraction of steel and a temperature delta to induce a given stress in the linear beam element presenting the post-tension cable. The concrete slab was modeled as a 12'×10'×4" thick plate composed of 480 six inch squares, as generally shown in FIG. 4. The model parameters were consistent with the limitations and requirements of ACI (American Concrete Institute) Standard 319-95, Chapter 18, "Prestress Concrete". Stresses were applied to both ends of the cable and friction loss due to bending of the post-tensioned cable was configured according to ACI guidelines. The computer generated stress contour maps for the building panel modeled as shown in FIG. 4 showing compression in the Y and X axes are shown in FIGS. 5 and 6 respectively, and the tabularized stress as shown in Table 1. The concrete slab of the cable configuration of U.S. Pat. No. 4,432,175 was also modeled as a 12'×10'×4" thick plate composed of 480 six inch squares, as generally shown in FIG. 7. The computer generated stress contour maps for the building panel modeled as shown in FIG. 7 showing compression in the Y and X axes are shown in FIGS. 8 and 9 respectively, and the tabularized stress as shown in Table 2.

TABLE 1

STRESS VALUES (BY ELEMENT) - NEW LOOP CONFIGURATION

| | Sx-x | Sy-y | | Sx-x | Sy-y | | Sx-x | Sy-y | | Sx-x | Sy-y | | Sx-x | Sy-y |
|---|---|---|---|---|---|---|---|---|---|---|---|---|---|---|
| 1 | −106 | −47 | 51 | −374 | −155 | 101 | 24 | −1312 | 151 | −615 | −483 | 201 | 19 | −1018 |
| 2 | −670 | −2218 | 52 | −388 | −162 | 102 | 108 | −1179 | 152 | −593 | −456 | 202 | 89 | −973 |
| 3 | −671 | −2203 | 53 | −437 | −482 | 103 | 292 | −913 | 153 | −561 | −451 | 203 | 260 | −803 |
| 4 | −86 | −67 | 54 | −356 | −482 | 104 | −655 | −1032 | 154 | −519 | −462 | 204 | −718 | −1003 |
| 5 | −77 | −5 | 55 | −398 | −190 | 105 | −517 | −1014 | 155 | −469 | −478 | 205 | −570 | −1034 |
| 6 | −116 | −23 | 56 | −468 | −153 | 106 | −581 | −901 | 156 | −420 | −487 | 206 | −632 | −986 |
| 7 | 112 | −13 | 57 | −44 | −290 | 107 | −596 | −727 | 157 | −370 | −522 | 207 | −652 | −856 |
| 8 | 14 | 21 | 58 | −53 | −74 | 108 | −613 | −597 | 158 | −189 | −474 | 208 | −679 | −753 |
| 9 | −2 | 27 | 59 | 15 | −92 | 109 | −605 | −498 | 159 | −131 | −327 | 209 | −675 | −681 |
| 10 | −70 | −13 | 60 | 4 | −132 | 110 | −598 | −431 | 160 | −16 | −156 | 210 | −623 | −608 |
| 11 | −68 | −39 | 61 | −39 | −1225 | 111 | −588 | −390 | 161 | −15 | −1075 | 211 | −639 | −542 |
| 12 | −7 | −13 | 62 | 105 | −1167 | 112 | −572 | −376 | 162 | −73 | −1014 | 212 | −603 | −496 |
| 13 | −148 | −27 | 63 | 151 | −1101 | 113 | −556 | −380 | 163 | −220 | −1050 | 213 | −608 | −484 |
| 14 | −203 | 24 | 64 | 231 | −725 | 114 | −547 | −402 | 164 | −283 | −1114 | 214 | −567 | −475 |
| 15 | −159 | −9 | 65 | −326 | −921 | 115 | −526 | −433 | 165 | −472 | −1088 | 215 | −509 | −485 |
| 16 | −185 | −6 | 66 | −794 | −930 | 116 | −523 | −487 | 166 | −545 | −955 | 216 | −432 | −498 |
| 17 | −196 | 21 | 67 | −635 | −450 | 117 | −489 | −465 | 167 | −584 | −841 | 217 | −330 | −509 |
| 18 | −143 | 11 | 68 | −503 | −475 | 118 | −658 | −320 | 168 | −673 | −737 | 218 | −192 | −478 |
| 19 | −59 | −9 | 69 | −461 | −437 | 119 | 234 | −106 | 169 | −628 | −642 | 219 | −72 | −331 |
| 20 | −13 | −14 | 70 | −508 | −312 | 120 | 45 | −377 | 170 | −632 | −567 | 220 | −18 | −29 |
| 21 | −50 | −723 | 71 | −503 | −131 | 121 | 8 | −1240 | 171 | −621 | −513 | 221 | 9 | −915 |
| 22 | 240 | −1556 | 72 | −500 | −287 | 122 | 55 | −1153 | 172 | −600 | −483 | 222 | 22 | −823 |
| 23 | 185 | −1497 | 73 | −436 | −376 | 123 | 206 | −1110 | 173 | −563 | −475 | 223 | −84 | −813 |
| 24 | −206 | −674 | 74 | −462 | −368 | 124 | −716 | −1208 | 174 | −513 | −482 | 224 | −47 | −1034 |
| 25 | −246 | −56 | 75 | −569 | −277 | 125 | −559 | −981 | 175 | −451 | −499 | 225 | −718 | −1237 |
| 26 | −170 | −35 | 76 | −721 | −626 | 126 | −546 | −903 | 176 | −569 | −522 | 226 | −648 | −971 |
| 27 | −123 | −145 | 77 | −310 | −421 | 127 | −584 | −782 | 177 | −252 | −519 | 227 | −745 | −850 |
| 28 | −88 | 122 | 78 | −141 | −1 | 128 | −606 | −657 | 178 | −152 | −451 | 228 | −715 | −727 |
| 29 | −134 | −143 | 79 | 6 | −194 | 129 | −618 | −558 | 179 | −80 | −296 | 229 | −708 | −654 |
| 30 | −159 | −118 | 80 | −14 | −195 | 130 | −616 | −486 | 180 | −28 | −57 | 230 | −743 | −660 |
| 31 | −181 | −100 | 81 | −23 | −1307 | 131 | −605 | −440 | 181 | 7 | −1061 | 231 | −395 | −551 |
| 32 | −207 | −100 | 82 | −78 | −1112 | 132 | −587 | −419 | 182 | 53 | −1031 | 232 | −700 | −505 |
| 33 | −232 | 143 | 83 | −2 | −1008 | 133 | −563 | −418 | 183 | 204 | −1110 | 233 | −663 | −439 |
| 34 | −152 | 137 | 84 | −31 | −1112 | 134 | −532 | −433 | 184 | −747 | −1156 | 234 | −626 | −447 |
| 35 | −204 | −113 | 85 | −636 | −1196 | 135 | −501 | −458 | 185 | −587 | −993 | 215 | −586 | −449 |
| 36 | −227 | 27 | 86 | −572 | −844 | 136 | −473 | −464 | 186 | −573 | −953 | 236 | −543 | −453 |
| 37 | −214 | 95 | 87 | −651 | −663 | 137 | −503 | −422 | 187 | −612 | −859 | 237 | −486 | −463 |
| 38 | −67 | 31 | 88 | −594 | −515 | 138 | −678 | −562 | 188 | −635 | −755 | 238 | −381 | −501 |

TABLE 1-continued

STRESS VALUES (BY ELEMENT) - NEW LOOP CONFIGURATION

| | Sx-x | Sy-y | | Sx-x | Sy-y | | Sx-x | Sy-y | | Sx-x | Sy-y | | Sx-x | Sy-y |
|---|---|---|---|---|---|---|---|---|---|---|---|---|---|---|
| 39 | −37 | −53 | 89 | −559 | −446 | 139 | 196 | −369 | 189 | −639 | −666 | 239 | −150 | −443 |
| 40 | −6 | −59 | 90 | −559 | −373 | 140 | 37 | −321 | 190 | −639 | −590 | 240 | −15 | −105 |
| 41 | 93 | −1057 | 91 | −564 | −327 | 141 | −15 | −1134 | 191 | −630 | −531 | 241 | −3 | −783 |
| 42 | 234 | −1278 | 92 | −538 | −332 | 142 | −75 | −1058 | 192 | −609 | −497 | 242 | −22 | −773 |
| 43 | 231 | −1184 | 93 | −517 | −356 | 143 | −214 | −1081 | 193 | −572 | −485 | 243 | −5 | −786 |
| 44 | 10 | −829 | 94 | −535 | −361 | 144 | −275 | −1130 | 194 | −528 | −489 | 244 | 110 | −575 |
| 45 | −10 | −86 | 95 | −582 | −418 | 145 | −465 | −1086 | 195 | −461 | −504 | 245 | −414 | −976 |
| 46 | −523 | −11 | 96 | −517 | −472 | 146 | −537 | −939 | 196 | −368 | −521 | 246 | −899 | −1130 |
| 47 | 427 | −282 | 97 | −617 | −655 | 147 | −576 | −815 | 197 | −257 | −516 | 247 | −780 | −700 |
| 48 | 381 | −549 | 98 | −33 | −404 | 148 | −605 | −704 | 198 | −147 | −452 | 248 | −700 | −741 |
| 49 | 400 | −519 | 99 | −98 | −181 | 149 | −622 | −607 | 199 | −56 | −292 | 249 | −705 | −702 |
| 50 | 370 | −179 | 100 | 1 | −253 | 150 | −624 | −532 | 200 | 7 | −19 | 250 | −829 | −443 |
| 251 | 0 | 0 | 301 | −320 | −505 | 351 | −677 | −298 | 401 | −20 | −256 | 451 | −432 | −32 |
| 252 | −792 | −330 | 302 | −93 | −582 | 352 | −678 | −328 | 402 | −16 | −272 | 452 | −443 | −66 |
| 253 | −718 | −424 | 303 | −165 | −588 | 353 | −679 | −368 | 403 | 98 | −63 | 453 | −465 | −125 |
| 254 | −682 | −414 | 304 | −284 | −537 | 354 | −677 | −412 | 404 | −421 | −388 | 454 | −485 | |
| 255 | −666 | −411 | 305 | −408 | −476 | 355 | −677 | −462 | 405 | −761 | −658 | 455 | −189 | 140 |
| 256 | −667 | −400 | 306 | −461 | −449 | 456 | −670 | −501 | 406 | −587 | −483 | 456 | −189 | −241 |
| 257 | −689 | −383 | 307 | −490 | −392 | 357 | −691 | −517 | 407 | −554 | −469 | 457 | −227 | −16 |
| 258 | −723 | −395 | 308 | −602 | −304 | 358 | −807 | −701 | 408 | −657 | −306 | 458 | −99 | −13 |
| 259 | −686 | −579 | 309 | −641 | −283 | 359 | 162 | −516 | 409 | −653 | −161 | 459 | −51 | −54 |
| 260 | −73 | −369 | 310 | −626 | −346 | 360 | 26 | 414 | 410 | −647 | −130 | 460 | −9 | −42 |
| 261 | −5 | −671 | 311 | −651 | −392 | 361 | 44 | −571 | 411 | −647 | −133 | 461 | −11 | −11 |
| 262 | −14 | −701 | 312 | −671 | −394 | 362 | 23 | −281 | 412 | −654 | −171 | 462 | −57 | −12 |
| 263 | −24 | −665 | 313 | −687 | −399 | −63 | −733 | −455 | 413 | −657 | −323 | 463 | −150 | −2 |
| 264 | −131 | −630 | 314 | −711 | −404 | 364 | −563 | −525 | 414 | −548 | −485 | 464 | −252 | −18 |
| 265 | −73 | −207 | 315 | −733 | −409 | 165 | −596 | −521 | 415 | −575 | −500 | 465 | −362 | 0 |
| 266 | −673 | −297 | 316 | −757 | −429 | 366 | −589 | −447 | 416 | −732 | −669 | 466 | −536 | 49 |
| 267 | −653 | −602 | 317 | −765 | −447 | 367 | −613 | −386 | 417 | −397 | −401 | 467 | −519 | 43 |
| 268 | −660 | −865 | 318 | −787 | −483 | 368 | −636 | −319 | 418 | −107 | −67 | 468 | −370 | 14 |
| 269 | −773 | −822 | 319 | −739 | −682 | 369 | −663 | −267 | 419 | −8 | −237 | 469 | −382 | −26 |
| 270 | −751 | −519 | 320 | −97 | −476 | 370 | −682 | −242 | 420 | −17 | −187 | 470 | −244 | −6 |
| 271 | −401 | −476 | 321 | −21 | −507 | 371 | −687 | −251 | 421 | −315 | −151 | 471 | −235 | −6 |
| 272 | −758 | −491 | 322 | −158 | −554 | 372 | −679 | −291 | 422 | −16 | −127 | 472 | −255 | −25 |
| 273 | −725 | −398 | 323 | −232 | −593 | 373 | −667 | −350 | 423 | −127 | −119 | 473 | −352 | −15 |
| 274 | −716 | −400 | 324 | −424 | −565 | 374 | −659 | −418 | 424 | −77 | 118 | 474 | −454 | 39 |
| 275 | −723 | −389 | 325 | −460 | −480 | 375 | −646 | −478 | 425 | −517 | −29 | 475 | −466 | 46 |
| 276 | −759 | −367 | 326 | −504 | −436 | 376 | −650 | −554 | 426 | −468 | −683 | 476 | −295 | −1 |
| 277 | −846 | −329 | 327 | −556 | −380 | 377 | −598 | −560 | 427 | −677 | −683 | 477 | −199 | −2 |
| 278 | −1027 | −269 | 328 | −608 | −326 | 378 | −734 | −467 | 428 | −604 | −160 | 478 | −116 | −2 |
| 279 | −1393 | −253 | 329 | −643 | −303 | 379 | −221 | −237 | 429 | −582 | −106 | 479 | −42 | −10 |
| 280 | −2176 | −1069 | 330 | −655 | −315 | 380 | −46 | −423 | 430 | −570 | −78 | 480 | −8 | −8 |
| 281 | −7 | −572 | 331 | −659 | −341 | 381 | −3 | −376 | 431 | −568 | −79 | | | |
| 282 | −38 | −627 | 332 | −675 | −363 | 382 | −714 | −305 | 432 | −578 | −110 | AVERAGE | −397.925 | −452.246 |
| 283 | −107 | −624 | 333 | −685 | −383 | 383 | −62 | −502 | 433 | −600 | −166 | AVEDEV | 271.1039 | 256.7913 |
| 284 | −180 | −511 | 334 | −695 | −408 | 384 | −715 | −714 | 434 | −679 | −684 | | | |
| 285 | −386 | −402 | 335 | −705 | −435 | 385 | −597 | −516 | 435 | −411 | −680 | COMBIN. | | |
| 286 | −459 | −421 | 336 | −716 | −465 | 386 | −625 | −485 | 436 | −470 | −51 | AVERAGE: | −425 | |
| 287 | −500 | −510 | 337 | −705 | −556 | 387 | −607 | −398 | 437 | −49 | 99 | | | |
| 288 | −511 | −199 | 338 | −498 | −640 | 388 | −634 | −314 | 438 | −104 | −117 | | | |
| 289 | −641 | −182 | 339 | −261 | −600 | 389 | −671 | −230 | 439 | −6 | −105 | | | |
| 290 | −623 | −448 | 340 | −27 | 326 | 390 | −680 | −187 | 440 | 0 | −113 | | | |
| 291 | −660 | −433 | 341 | 36 | −595 | 391 | −682 | −193 | 441 | −12 | −57 | | | |
| 292 | −650 | −422 | 342 | 196 | −530 | 392 | −678 | −247 | 442 | −65 | −65 | | | |
| 293 | −706 | −419 | 343 | −745 | −656 | 393 | −645 | −338 | 443 | −127 | −13 | | | |
| 294 | −722 | −397 | 344 | −568 | −479 | 394 | −622 | −425 | 444 | −271 | −8 | | | |
| 295 | −743 | −391 | 345 | −534 | −479 | 395 | −639 | −512 | 445 | −297 | −100 | | | |
| 296 | −783 | −379 | 346 | −557 | −439 | 396 | −604 | −544 | 446 | −257 | −254 | | | |
| 297 | −869 | −351 | 347 | −588 | −380 | 397 | −705 | −729 | 447 | −496 | −224 | | | |
| 298 | −1049 | −299 | 348 | −625 | −327 | 398 | −60 | −499 | 448 | −481 | −126 | | | |
| 299 | −1404 | −289 | 349 | −654 | −292 | 399 | −106 | −261 | 449 | −456 | −67 | | | |
| 300 | −2179 | −1101 | 350 | −671 | −283 | 400 | 1 | −270 | 450 | −437 | −32 | | | |

TABLE 2

STRESS VALUES (BY ELEMENT) - ORIGINAL LOOP CONFIGURATION

| | Sx-x | Sy-y | | Sx-x | Sy-y | | Sx-x | Sy-y | | Sx-x | Sy-y | | Sx-x | Sy-y |
|---|---|---|---|---|---|---|---|---|---|---|---|---|---|---|
| 1 | −138 | −138 | 51 | −496 | −83 | 101 | −11 | −520 | 151 | −355 | −391 | 201 | −1 | −281 |
| 2 | −1307 | −2253 | 52 | −511 | −120 | 102 | −42 | −667 | 152 | −349 | −413 | 202 | −9 | −367 |
| 3 | −1506 | −2104 | 53 | −538 | −176 | 103 | −133 | −690 | 153 | −339 | −440 | 203 | −26 | −43 |

TABLE 2-continued

STRESS VALUES (BY ELEMENT) - ORIGINAL LOOP CONFIGURATION

| | Sx-x | Sy-y | | Sx-x | Sy-y | | Sx-x | Sy-y | | Sx-x | Sy-y | | Sx-x | Sy-y |
|---|---|---|---|---|---|---|---|---|---|---|---|---|---|---|
| 4 | −895 | −36 | 54 | −616 | −696 | 104 | −247 | −613 | 154 | −327 | −470 | 204 | −53 | −476 |
| 5 | −632 | −2 | 55 | −423 | −693 | 105 | −333 | −503 | 155 | −314 | −495 | 205 | −88 | −496 |
| 6 | −513 | −11 | 56 | −482 | −31 | 106 | −392 | −404 | 156 | −310 | −509 | 206 | −127 | −500 |
| 7 | −431 | −1 | 57 | −53 | −121 | 107 | −430 | −328 | 157 | −305 | −555 | 207 | −166 | −492 |
| 8 | −371 | −3 | 58 | −113 | −113 | 108 | −451 | −279 | 158 | −160 | −532 | 208 | −201 | −477 |
| 9 | −327 | −3 | 59 | −11 | −123 | 109 | −461 | −255 | 159 | −128 | −445 | 209 | −231 | −477 |
| 10 | −299 | −4 | 60 | −2 | −155 | 110 | −466 | −254 | 160 | −14 | −373 | 210 | −229 | −498 |
| 11 | −289 | −7 | 61 | −36 | −898 | 111 | −467 | −275 | 161 | −2 | −339 | 211 | −228 | −520 |
| 12 | −390 | −28 | 62 | −580 | −1064 | 112 | −459 | −318 | 162 | −13 | −427 | 212 | −220 | −515 |
| 13 | −383 | −15 | 63 | −597 | −791 | 113 | −449 | −375 | 163 | −39 | −485 | 213 | −216 | −506 |
| 14 | −526 | −41 | 64 | −599 | −597 | 114 | −448 | −436 | 164 | −80 | −509 | 214 | −180 | −512 |
| 15 | −539 | −48 | 65 | −620 | −402 | 115 | −451 | −482 | 165 | −130 | −505 | 215 | −141 | −526 |
| 16 | −366 | 0 | 66 | −617 | −250 | 116 | −488 | −535 | 166 | −182 | −485 | 216 | −101 | −524 |
| 17 | −257 | −18 | 67 | −584 | −165 | 117 | −485 | −516 | 167 | −229 | −459 | 217 | −63 | −498 |
| 18 | −155 | −1 | 68 | −551 | −127 | 118 | −685 | −420 | 168 | −265 | −438 | 218 | −32 | −442 |
| 19 | −60 | −12 | 69 | −530 | −113 | 119 | −253 | −234 | 169 | −289 | −428 | 219 | −11 | −353 |
| 20 | −12 | −12 | 70 | −521 | −117 | 120 | −49 | −539 | 170 | −300 | −429 | 220 | −1 | −233 |
| 21 | −2251 | −1307 | 71 | −523 | −139 | 121 | −1 | −440 | 171 | −302 | −439 | 221 | −1 | −263 |
| 22 | −1227 | −1229 | 72 | −536 | −183 | 122 | −26 | −555 | 172 | −296 | −453 | 222 | −8 | −354 |
| 23 | −888 | −1201 | 73 | −550 | −332 | 123 | −79 | −599 | 173 | −284 | −471 | 223 | −24 | −425 |
| 24 | −1064 | −579 | 74 | −461 | −492 | 124 | −156 | −577 | 174 | −265 | −491 | 224 | −50 | −472 |
| 25 | −846 | −97 | 75 | −510 | −499 | 125 | −236 | −516 | 175 | −241 | −511 | 225 | −83 | −497 |
| 26 | −667 | −42 | 76 | −702 | −665 | 126 | −301 | −446 | 17 | −209 | −533 | 226 | −120 | −504 |
| 27 | −557 | −27 | 77 | −380 | −383 | 127 | −350 | −387 | 177 | −147 | −535 | 227 | −55 | −501 |
| 28 | −485 | −20 | 78 | −122 | −53 | 128 | −382 | −345 | 178 | −100 | −494 | 228 | −185 | −189 |
| 29 | −441 | −19 | 79 | −6 | −261 | 129 | −402 | −323 | 179 | −66 | −410 | 229 | −209 | −460 |
| 30 | −420 | −23 | 80 | −18 | −258 | 130 | −411 | −321 | 180 | −26 | −287 | 230 | −247 | −516 |
| 31 | −420 | −34 | 81 | −2 | −637 | 131 | −412 | −336 | 181 | −2 | −306 | 231 | −194 | −579 |
| 32 | −434 | −74 | 82 | −98 | −846 | 132 | −406 | −367 | 182 | −11 | −391 | 232 | −240 | −532 |
| 33 | −456 | −134 | 83 | −300 | −789 | 133 | −597 | −407 | 183 | −31 | −453 | 231 | −190 | −483 |
| 34 | −469 | −219 | 84 | −403 | −617 | 134 | −389 | −448 | 184 | −63 | −488 | 234 | −158 | −518 |
| 35 | −240 | −250 | 85 | −465 | −465 | 135 | −391 | −487 | 185 | −104 | −499 | 235 | −121 | −528 |
| 36 | −283 | −100 | 86 | −502 | −340 | 136 | −401 | −499 | 186 | −148 | −493 | 236 | −84 | −520 |
| 37 | −262 | −6 | 87 | −515 | −253 | 137 | −472 | −468 | 187 | −191 | −478 | 237 | −49 | −489 |
| 38 | −123 | −10 | 88 | −513 | −204 | 138 | −686 | −617 | 188 | −227 | −465 | 238 | −22 | −403 |
| 39 | −64 | −64 | 89 | −509 | −182 | 139 | 223 | −467 | 189 | −250 | −461 | 239 | −6 | −341 |
| 40 | −12 | −60 | 90 | −507 | −183 | 140 | 42 | −523 | 190 | −259 | −469 | 240 | −1 | −227 |
| 41 | −2101 | −1507 | 91 | −509 | −205 | 141 | −3 | −383 | 191 | −256 | −480 | 241 | −1 | −252 |
| 42 | −1200 | −888 | 92 | −510 | −264 | 142 | −17 | −479 | 192 | −252 | −488 | 242 | −9 | −351 |
| 43 | −849 | −848 | 93 | −486 | −353 | 143 | −54 | −532 | 193 | −240 | −495 | 243 | −27 | −427 |
| 44 | −793 | −596 | 94 | −479 | −433 | 144 | −108 | −53 | 194 | −16 | −507 | 244 | −55 | −476 |
| 45 | −792 | −299 | 95 | −518 | −509 | 145 | −171 | −513 | 195 | −181 | −522 | 245 | −89 | −501 |
| 46 | −695 | −134 | 96 | −513 | −526 | 146 | −232 | −471 | 196 | −137 | −529 | 246 | −126 | −509 |
| 47 | −607 | −83 | 97 | −656 | −707 | 147 | −282 | −430 | 197 | −95 | −513 | 247 | −161 | −503 |
| 48 | −547 | −62 | 98 | −28 | −481 | 148 | −318 | −398 | 198 | −58 | −464 | 248 | −189 | −493 |
| 49 | −510 | −56 | 99 | −99 | −281 | 149 | −342 | −381 | 199 | −24 | −378 | 249 | −209 | −477 |
| 50 | −494 | −60 | 100 | −1 | −367 | 150 | −353 | −380 | 200 | −5 | −249 | 250 | −220 | −263 |
| 251 | 0 | 0 | 301 | −27 | −288 | 351 | −132 | −349 | 401 | −18 | −254 | 451 | −370 | −38 |
| 252 | −208 | −271 | 302 | −68 | −408 | 352 | −424 | −369 | 402 | −6 | −258 | 452 | −387 | −71 |
| 253 | −186 | −499 | 303 | −105 | −488 | 353 | −412 | −402 | 403 | −120 | 249 | 453 | −413 | −110 |
| 254 | −156 | −519 | 304 | −155 | −525 | 354 | −401 | −439 | 404 | −384 | −378 | 454 | −431 | −210 |
| 255 | −122 | −526 | 305 | −219 | −520 | 355 | −400 | −477 | 405 | −707 | −660 | 455 | −207 | −246 |
| 256 | −84 | −519 | 306 | −254 | −495 | 356 | −406 | −491 | 406 | −508 | −492 | 456 | −264 | −90 |
| 257 | −49 | −189 | 307 | −283 | −473 | 357 | −473 | −462 | 407 | −459 | −483 | 457 | −249 | 0 |
| 258 | −22 | −429 | 308 | −307 | −453 | 358 | −686 | −613 | 408 | −542 | −324 | 458 | −118 | −9 |
| 259 | −6 | −−340 | 309 | −321 | −443 | 359 | 223 | −461 | 409 | −531 | −183 | 459 | −62 | −61 |
| 260 | −1 | −226 | 310 | −324 | −445 | 360 | 42 | −515 | 410 | −521 | −150 | 460 | −12 | −57 |
| 261 | −2 | −248 | 311 | −318 | 451 | 361 | 48 | −533 | 411 | −521 | −150 | 461 | −12 | −12 |
| 262 | −14 | −359 | 312 | −313 | −457 | 362 | 252 | −232 | 412 | −529 | −183 | 462 | −59 | −12 |
| 263 | −37 | −438 | 313 | −301 | −466 | 363 | −689 | −417 | 413 | −539 | −324 | 463 | −152 | −1 |
| 264 | −71 | −486 | 314 | −280 | −482 | 364 | −490 | −509 | 414 | −447 | −479 | 464 | −250 | −16 |
| 265 | −109 | −509 | 315 | −250 | −502 | 365 | −495 | −526 | 415 | −489 | −487 | 465 | −351 | 0 |
| 266 | −149 | −510 | 316 | −214 | −526 | 366 | −462 | −470 | 416 | −668 | −665 | 466 | −510 | −48 |
| 267 | −185 | −501 | 317 | −150 | −529 | 367 | −462 | −424 | 417 | −400 | −394 | 467 | −487 | −42 |
| 268 | −214 | −485 | 318 | −101 | −489 | 368 | −465 | −366 | 418 | −114 | −46 | 468 | −325 | −14 |
| 269 | −237 | −452 | 319 | −66 | −405 | 369 | −477 | −317 | 419 | −9 | −254 | 469 | −235 | −29 |
| 270 | −276 | −510 | 320 | −26 | −281 | 370 | −486 | −288 | 420 | −18 | −249 | 470 | −201 | −8 |
| 271 | −211 | −568 | 321 | −15 | −370 | 371 | −484 | −289 | 421 | −1 | −153 | 471 | −200 | −7 |
| 272 | −263 | −520 | 322 | −130 | −440 | 372 | −473 | −320 | 422 | −11 | −120 | 472 | −233 | −27 |
| 273 | −213 | −472 | 323 | −165 | −524 | 373 | −459 | −369 | 423 | −113 | −109 | 473 | −319 | −15 |
| 274 | −180 | −510 | 324 | −312 | −545 | 374 | −456 | −425 | 424 | −55 | −127 | 474 | −472 | −40 |
| 275 | −143 | −524 | 325 | −320 | −497 | 375 | −456 | −471 | 425 | −488 | −23 | 475 | −500 | −48 |
| 276 | −103 | −521 | 326 | −329 | −480 | 376 | −489 | −528 | 426 | −439 | −691 | 476 | −344 | −2 |
| 277 | −65 | −496 | 327 | −346 | −455 | 377 | −484 | −513 | 427 | −576 | −688 | 477 | −245 | −16 |
| 278 | −32 | −440 | 328 | −361 | −427 | 378 | −684 | −417 | 428 | −508 | −174 | 478 | −148 | −1 |

TABLE 2-continued

STRESS VALUES (BY ELEMENT) - ORIGINAL LOOP CONFIGURATION

| | Sx-x | Sy-y | | Sx-x | Sy-y | | Sx-x | Sy-y | | Sx-x | Sy-y | | Sx-x | Sy-y |
|---|---|---|---|---|---|---|---|---|---|---|---|---|---|---|
| 279 | −12 | −350 | 329 | −373 | −408 | 379 | 253 | −229 | 429 | −486 | −120 | 479 | −57 | −12 |
| 280 | −2 | −230 | 330 | −377 | −400 | 380 | 48 | −530 | 430 | −475 | −90 | 480 | −11 | −11 |
| 281 | −6 | −256 | 331 | −375 | −403 | 381 | 0 | −362 | 431 | −475 | −90 | | | |
| 282 | −27 | −379 | 332 | −368 | −415 | 382 | −100 | −277 | 432 | −487 | −118 | AVERAGE: | −293 | −375 |
| 283 | −64 | −460 | 333 | −356 | −416 | 383 | −30 | −477 | 433 | −512 | −171 | AVEDEV: | 194 | 176 |
| 284 | −103 | −503 | 334 | −341 | −462 | 384 | −660 | −702 | 434 | −587 | −678 | | | |
| 285 | −147 | −516 | 335 | −324 | −485 | 385 | −517 | −519 | 435 | −389 | −676 | COMBIN. | | |
| 286 | −192 | −507 | 336 | −316 | −501 | 386 | −523 | −500 | 436 | −438 | −10 | AVERAGE: | −334 | |
| 287 | −227 | −490 | 337 | −307 | −549 | 387 | −486 | −423 | 437 | −66 | −134 | | | |
| 288 | −256 | −469 | 338 | −161 | −526 | 388 | −495 | −344 | 438 | −117 | −107 | | | |
| 289 | −283 | −465 | 339 | −128 | −439 | 389 | −520 | −263 | 439 | −12 | −117 | | | |
| 290 | −275 | −482 | 340 | −14 | −366 | 390 | −521 | −218 | 440 | −2 | −149 | | | |
| 291 | −273 | −500 | 341 | −42 | −518 | 391 | −520 | −219 | 441 | −12 | −59 | | | |
| 292 | −263 | −493 | 342 | −221 | −459 | 392 | −516 | −264 | 442 | −63 | −62 | | | |
| 293 | −260 | −486 | 343 | −689 | −608 | 393 | −489 | −345 | 443 | −121 | −8 | | | |
| 294 | −224 | −495 | 344 | −478 | −459 | 394 | −477 | −421 | 444 | −260 | −2 | | | |
| 295 | −186 | −517 | 345 | −411 | −488 | 395 | −513 | −498 | 445 | −283 | −94 | | | |
| 296 | −141 | −525 | 346 | −405 | −474 | 396 | −509 | −521 | 446 | −246 | −250 | | | |
| 297 | −97 | −509 | 347 | −407 | −435 | 397 | −651 | −708 | 447 | −415 | −224 | | | |
| 298 | −60 | −460 | 348 | −418 | −397 | 398 | −31 | −481 | 448 | −408 | −135 | | | |
| 299 | −25 | −374 | 349 | −428 | −365 | 399 | −101 | −274 | 449 | −386 | −75 | | | |
| 300 | −5 | −245 | 350 | −434 | −348 | 400 | 0 | −357 | 450 | −370 | −38 | | | |

As can be seen from Tables 1 and 2, a considerable improvement has been achieved with the new concrete building panel configuration. First, there has been a reduction in variation in compressive stress values between the Y and X axes from 28% to 14%. At the same time the increase in the average pre-compressive force with the new cable configuration is a 27% increase (from 334 psi to 425 psi) over the pattern achieved in the concrete building panel of U.S. Pat. No. 4,432,175. The increased pre-compression force further enhances the concrete building panel in the following areas:

1. Allowable load capacity in flexure—ACI 18.7.1
2. Resist punching shear—ACI 11.12.2.2
3. Reduced deflection—ACI 9.5.4.1
4. Enhanced Autogenous Healing (Neville'publication *Properties of Concrete,* Fourth Edition)

While the invention has been described in terms of a single preferred embodiment, those skilled in the art will recognize that the invention can be practiced with modification within the spirit and scope of the appended claims.

What is claimed is:

1. A method of manufacturing a post tensioned prefabricated concrete building panel comprising the steps of:

positioning a cable member around a perimeter and through a central portion of a mold such that the cable member has no less than 2.5 parallel portions of the cable member in any direction;

pouring concrete into the mold to form the concrete building panel;

removing the mold from the concrete building panel;

exerting a predetermined tensioning force on the cable member after the removing step; and securing a first end of the cable member at a corner of the concrete building panel and a second end of the cable member at a side of the concrete building panel which opposes the corner after exerting the predetermined tensioning force.

2. The method of manufacturing a post tensioned prefabricated concrete building panel recited in claim 1 further comprising the step of initially tensioning the cable member after the concrete has become relatively hardened and prior to removing the mold.

3. The method of manufacturing a post tensioned prefabricated concrete building panel recited in claim 1 wherein the predetermined tensioning force puts a stress in the cable member of approximately 0.7 $F_u$ or 270 kips per square inch (ksi).

4. The method of manufacturing a post tensioned prefabricated concrete building panel recited in claim 1 wherein the step of positioning the cable member results in a pattern in which the cable member starts from one corner of the concrete building panel to a point where the cable member entered the concrete building panel and at a point turning 90° to follow the cable member to a point midway up a Y axis of the concrete building panel and then turning 90° across a X axis of the concrete building panel to bisect the concrete building panel and cross an opposite parallel portion of the cable member to exit out an adjacent side of the concrete building panel.

5. The method of manufacturing a post tensioned prefabricated concrete building panel recited in claim 1 wherein the step of positioning the cable member includes positioning a portion of the cable member between opposing sides of the cable member within the mold.

6. The method of manufacturing a post tensioned prefabricated concrete building panel recited in claim 1 wherein the step of positioning the cable member includes positioning the cable member parallel to at least one side of the mold in any direction.

7. The method of manufacturing a post tensioned prefabricated concrete building panel recited in claim 1 wherein the step of positioning the cable member includes positioning the cable member such that the cable member has 2.5 parallel portions of the cable member in a first direction and 3 parallel portions of the cable member in a second direction perpendicular to the first direction.

* * * * *